United States Patent [19]

Smith

[11] B 3,986,156

[45] Oct. 12, 1976

[54] YOKE MOUNT ASSEMBLY

[75] Inventor: Bradford Knox Smith, Lititz, Pa.

[73] Assignee: RCA Corporation, New York, N.Y.

[22] Filed: Jan. 16, 1975

[21] Appl. No.: 541,517

[44] Published under the second Trial Voluntary Protest Program on January 13, 1976 as document No. B 541,517.

[52] U.S. Cl. ..... 335/210; 178/7.81

[51] Int. Cl.[2] ..... H01F 7/00

[58] Field of Search ..... 178/7.8, 7.81; 335/210, 335/212

[56] References Cited

UNITED STATES PATENTS

| | | | |
|---|---|---|---|
| 3,629,751 | 12/1971 | Massa | 335/212 |
| 3,633,137 | 1/1972 | Thurnell | 335/212 |
| 3,697,909 | 10/1972 | Christensen et al. | 335/210 |

*Primary Examiner*—G. Harris

*Attorney, Agent, or Firm*—Glenn H. Bruestle; Carl L. Silverman

[57] ABSTRACT

A plurality of rigid members are utilized for connecting a yoke combination to a platform which is disposed on a television picture tube. The connecting members are shaped such that substantially constant physical contact is maintained between the connecting member, the yoke combination and the platform while the yoke position is adjusted. The yoke combination can be fixed into the optimum position in a permanent nonadjustable fashion through the use of ultrasonic welding or through the use of a small amount of adhesive material.

10 Claims, 6 Drawing Figures

YOKE MOUNT ASSEMBLY

BACKGROUND OF THE INVENTION

This invention relates to a yoke mount assembly for a cathode-ray tube, and particularly to an assembly in which the yoke is fixed to the cathode-ray tube.

Cathode-ray tubes, such as color television picture tubes, may require a magnetic-deflection yoke mounted on the outside of the tube envelope. The yoke comprises horizontal and vertical deflection coils and a suitable core or cores therefor. In some color television picture tubes, the yoke deflects three electron beams in both the vertical and horizontal directions to scan the viewing screen of the tube. In some tube-yoke combinations, the position of the yoke is adjusted relative to the tube and the yoke is then fixed on the tube in the adjusted position.

Several structures have been proposed for mounting and holding the yoke in the desired position on the tube. Usually the yoke is located in a housing. In one structure, the housing and yoke are positioned on the tube and potted in place. When the yoke and yoke housing are potted in place, the potting compound generally fills the space between the housing and the tube. This may require a bulky body of potting material, which may result in poor rigidity and stability of the yoke during tube operation. In addition, an uneconomical quantity of potting material may be required. The large quantity of potting material may require time consuming heat up and cooling steps when a hot melt potting compound is utilized.

Thus, it would be desirable to develop a yoke mount assembly for a cathode-ray tube which would substantially minimize the problems of the prior art, i.e., an assembly suitable for high speed production. Such an assembly would have a reduced or eliminated potting material requirement.

SUMMARY OF THE INVENTION

A yoke mount assembly for a television picture tube of the type having a magnetic deflection yoke in operational relationship with the tube, a platform positioned on the external surface of the tube and a yoke combination which includes a housing which encloses at least a portion of the yoke. The improvement includes a plurality of rigid members disposed between and connecting the yoke combination and the platform. The connecting members permit adjustment of the position of the yoke combination with respect to the platform. Each one of the connecting members has a pair of end portions which are shaped such that substantially constant physical contact is maintained between one of the end portions of the connecting member and the yoke combination and the other of the end portions and the platform while the yoke position is adjusted.

DETAILED DESCRIPTION OF THE INVENTION

Figure 1:
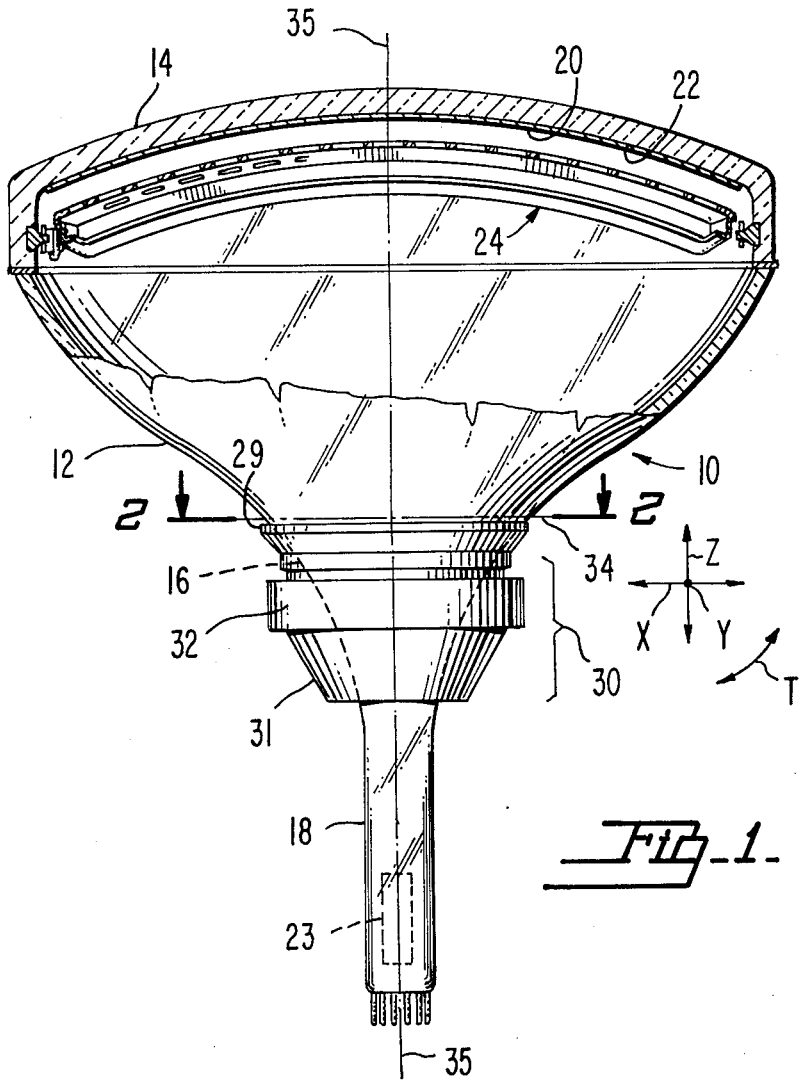
FIG. 1 is a partial broken-away elevational view of a cathode-ray tube-platform-yoke combination which utilizes the yoke mount assembly of the present invention.

FIG. 1 illustrates a color television picture tube 10 of the apertured-mask type which includes an evacuated glass envelope 12. The envelope 12 includes a faceplate panel 14, a funnel 16, and a neck 18. A three-color phosphor viewing screen 20 is supported on the inner surface 22 of the faceplate panel 14. A preferred viewing screen 20 is of a known line type. An electron-gun assembly 23 positioned in the neck 18 includes three electron guns (not shown), one for each of the three color phosphor on the viewing screen 20. An apertured mask 24 is positioned in the faceplate panel 14 adjacent the viewing screen 20. The apertured mask 24 used with the line-type viewing screen 20 includes slot-shaped apertures. The electron-gun assembly 23 is adapted to project three electron beams toward the viewing screen 20 through the apertured mask 24 so as to strike the viewing screen 20. The preferred electron-gun assembly 23 is of the in-line type, that is, a type which projects a plurality of electron beams which are in a line towards the screen 20.

A platform 29 is fixed to the outside surface of the funnel 16. A yoke combination 30, which includes a yoke 31 and a housing 32 for the yoke 31, is positioned around the envelope 12 near the transition between the funnel 16 and the neck 18. The platform 29 and the housing 32 are preferably of a non-magnetic material, e.g., a plastic, such as polyphenylene oxide. A preferred yoke 31 is comprised of two pairs of opposed magnetic-field-producing coils (not shown) having toroidal winding. The yoke 31 may also include a direct current or permanent magnet such as a convergence or purity device (not shown). The housing 32 with the yoke 31 therein is mounted on the platform 29 and the tube 10 in accordance with the present invention, as will be described.

Figure 2:
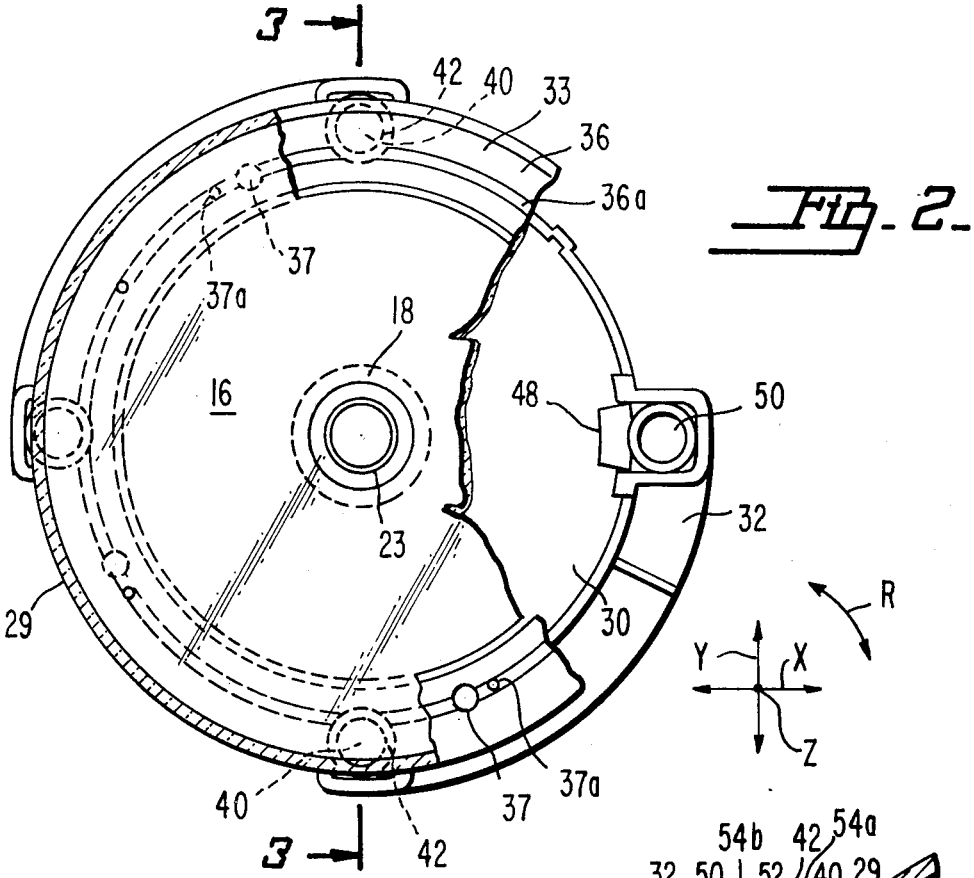
FIG. 2 is an enlarged broken-away sectional view of a portion of the combination taken along line 2—2 of FIG. 1.
Figure 3:
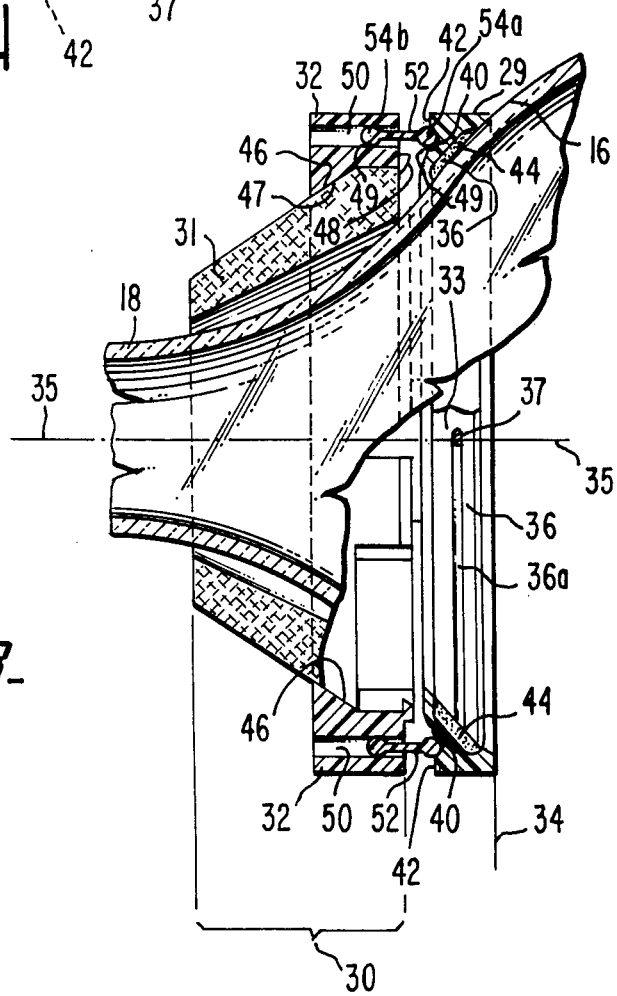
FIG. 3 is a sectional view of the combination taken along line 3—3 of FIG. 2.

The relationship between the tube 10, the platform 29 and the yoke combination 30 can be more clearly described through the use of FIGS. 2 and 3. The platform 29 is a circular ring-shaped member which is positioned around the funnel 16. The platform 29 includes a forward inner surface 33 contoured to substantially conform to a portion of the outer surface of the funnel 16. The platform 29 is concentrically positioned on the funnel 16 in a plane 34 substantially perpendicular to the axis 35 of the tube 10, as shown in FIG. 1. The forward inner surface 33 of the platform 29 includes an annular recess 36, as shown in FIGS. 2 and 3. As shown in FIG. 2, it may be preferable in some cases to provide an additional recess **36*a* within the recess 36 so as to give the structure greater flexibility. The platform 29 also includes holes or passageways 37 and 37*a* therethrough opening into the recess 36, as shown in FIG. 2. The passageways 37 and 37*a* extend from portions of the platform 29 which are opposite the recess 36. With the platform 29 positioned against the funnel 16 as described above, the recess 36 forms an enclosure between the funnel 16 and the platform 29, as shown in FIG. 3. The platform 29 also includes a plurality of projections 42 opposite the recess 36. The projections 42 include recesses 40 which are utilized in connecting the platform 29 to the yoke combination 30**.

A first hardened adhesive material 44, i.e., potting compound, substantially fills the enclosure fixing the platform 29 to the funnel 16 in a nonadjustable position, as shown in FIG. 3. The preferred first adhesive material is a hot-melt thermoplastic adhesive material. The adhesive material 44 can be inserted into the enclosure through the passageways 37. The passageways 37*a* can be used to observe the flow of the adhesive material, as is known in the art.

The first adhesive material should remain solid at a tube operating temperature of about 50°C and yoke operating temperature of about 100°C and must melt below the temperature at which damage to the yoke 31, the tube 10, or the platform 29 would result so as to permit economical salvage of component parts, e.g., about 150°C. After solidification the material must have good adhesion to the glass envelope 12 and the platform 29, which may be a plastic. It is also desirable that the first adhesive material be fast-solidifying to permit economical processing of a large number of assemblies. It is preferred that the first adhesive material solidify within about 15 seconds or less after its application is complete. Suitable materials and melting temperatures are:

| Material Designation | Marketed by General Mills Chemical Co., Minneapolis, Minn. | Melting Temperature |
|---|---|---|
| Versalon 1138 | " | 124°C |
| Versalon 1165 | " | 134°C |

The yoke 31 is mounted in a housing 32. The housing 32 also comprises a ring-shaped member which includes an inner surface 46 formed so as to substantially conform to a portion of the exterior surface 47 of the yoke 31, as shown in FIG. 3. The housing 32 also includes a plurality of recesses 50 which correspond to the recesses 40 of the platform 29, as shown in FIGS. 2 and 3. The yoke 31 may be temporarily retained in a fixed position in the housing 32 by flexible hooks 48 formed as part of the housing 32, as shown in FIGS. 2 and 3. The yoke 31 may also be permanently fixed to the housing 32 prior to adjustment so as to avoid the use of the flexible hooks 48.

Figure 4:
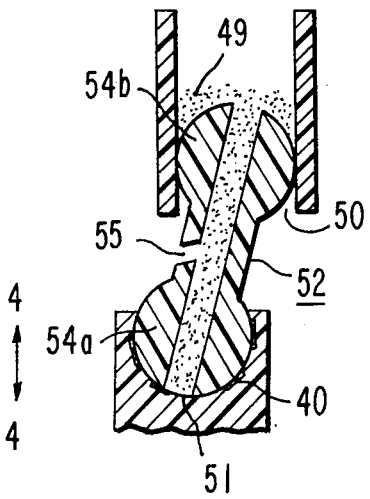
FIGS. 4, 5, and 6 are sectional views showing structures suitable for use in the yoke mount assembly of the present invention for connecting the platform to the yoke combination.

A plurality of rigid members 52 are disposed between and connect the yoke combination 30 and the platform 29, as shown in FIG. 3. The connecting members 52 may be of any suitable material, e.g., a plastic such as polyphenylene oxide. The rigid connecting members 52 are shaped so as to include a pair of substantially spherically shaped end portions 54*a* and 54*b* with a cylindrical portion therebetween, as shown in FIGS. 3 and 4. The recesses 40 and 50 of the platform 20 and yoke combination 30 are each adapted so as to closely receive the respective end portions 54*a* and 54*b* of the member 52. Thus, the recesses 40 of the platform 29 receive the spherically shaped end portions 54*a* and the recesses 50 of the yoke combination 30 receive the end portions 54*b* as shown in FIGS. 3 and 4.

Since the relationship between the end portions 54*a* and 54*b* and the recesses 40 and 50 is similar to that of a sphere in a socket, substantially continuous physical contact is maintained between the recesses 40 and 50 and the respective end portions 54*a* and 54*b* of the rigid connecting members 52 while the position of the yoke combination 30 is adjusted with respect to the platform 29, as shown in FIGS. 3 and 4. Consequently, the yoke combination 30 can be adjusted in relation to the tube 10 within the range of yoke adjustment into the optimum position by translation parallel to the axis 35 of the tube 10 in directions shown by arrows X and Y in FIG. 2, translation along to the axis 35 of the tube 10 in directions shown by arrow Z in FIG. 1, rotation around the axis 35 of the tube 10 in a direction shown by arrow R in FIG. 2 and tilting or rotation with respect to the axis 35 of the tube 10 in a direction shown by arrow T in FIG. 1.

The mechanism by which the translation necessary for yoke adjustment occurs can be seen clearly in FIGS. 3 and 4. The end portion 54*a* of the connection member 52 in the recess 40 of the platform 29 is capable of pivotal motion about its center but cannot move in an axial direction 4—4 past the retaining wall 51 of the recess 40. The end portion 54*b* in the recess 50 of the yoke combination 30 is capable of both pivotal motion about its center and axial motion in the recess 50.

After the optimum position of yoke adjustment has been achieved, a second liquid adhesive material 49 can then be used, if desired, to fix the yoke combination 30 into the optimum position in a permanent nonadjustable fashion. By permanent nonadjustable position it is meant a position which cannot be further adjusted without special tools or techniques, i.e., permanent for use in operation. The second adhesive 49 is injected in the fluid state into the space between the end portions 54*a* and 54*b* of the connecting member 52 and the recesses 40 and 50. The second adhesive 49 can be inserted into the recess 50 through the open end of the recess 50, as shown in FIGS. 3 and 4. If desired, the rigid member 52 can be provided with a passageway 55 therethrough, as shown in FIG. 4, so as to provide a means for communicating the liquid adhesive 49 into the recesses 40 and 50 for fixing the yoke combination 30 into the optimum position in relation to the tube 10. If the passageway 55 is utilized, it may be desirable to cover the open end of the recess 50 (not shown). If adhesive material is used, the position cannot be further adjusted, except by either removal or reheating of the adhesive material. Thus, with the adhesive material hardened, no further adjustment can be practically accomplished.

The preferred second adhesive material 49 is also a hot-melt thermoplastic adhesive material and may be chosen from the group of materials previously suggested for use as the first adhesive material. The second adhesive material must also, after hardening, have good adhesion to the platform 29 and housing 32 which may be a plastic. It is preferred that the second adhesive material harden within about 30 seconds after injection is complete.

Figure 5:
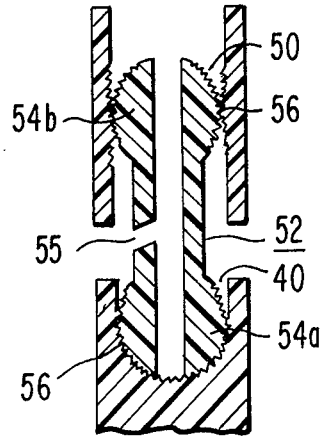

It may be preferable in some instances to roughen the contacting surfaces of the recesses 40 and 50 and the end portions 54*a* and 54*b* of the connecting members 52 so as to promote good bonding strength. For example, the end portions 54*a* and 54*b* can contact the recesses 40 and 50 in a plurality of ridges 56, as shown in FIG. 5. The ridges 56 are preferably disposed such that they do not interlock with each other so as to permit the desired translations. The ridges 56 can provide good mechanical locking which is substantially independent of the bonding material utilized.

Figure 6:
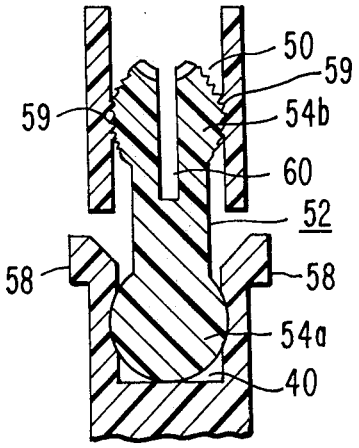

Another form of yoke mount assembly of the present invention may employ a rigid connecting member 52 in cooperation with a platform 29 and yoke combination 30 wherein the platform recesses 40 receive the end portions 54*a* in locking fashion, as shown in FIG. 6. The recess 40 includes an outer locking region 58 of slightly smaller size than the end portion 54*a* such that a force, e.g., 15 lbs., is required to snap the end portion 54*a* into and out of the recess 40. Once inserted, the end portion 54*a* is locked in place. As previously discussed, the recess 40 of FIG. 6 still permits pivotal motion of the end portion 54*a* in the recess 40. Then, the end portion 54*b* can be inserted into and rigidly bonded in the recess 50. It may be preferable, in some cases, to provide the end portion 54*b* with a slit 60 for bonding convenience. When the end portion 54*b* is bonded in the recess 50, the position of the end portion 54*a* is thereby fixed with reference to the yoke combination 30. Consequently, a plurality of rigid connecting members 52 can be utilized such that only one end portion 54*b* need be bonded; the end portion 54*a* being held in place by the locking region 58.

Once the yoke mount assembly, partly shown in FIG. 6, is adjusted into the optimum position, and then bonded as discussed above, a predetermined removal force, e.g., 15–60 lbs., is necessary for disassembly. Thus, with the yoke combination 30 in fixed position, i.e., the end portions 54*a* snapped in place, the end portions 54*b* bonded, no translation of the yoke combination-platform-tube adjustment is possible until the predetermined removal forces are exceeded. Therefore, the yoke assembly partly shown in FIG. 6, provides a salvage technique for removing the yoke combination 30 without damaging the tube 10 and the platform 29.

The yoke assembly of the present invention has heretofore been described as employing a hot melt, i.e., adhesive or potting compound, for fixing the yoke combination 30 into the optimum position in a permanent nonadjustable fashion. However, other known means can also be employed to fix the position of the yoke combination 30 while substantially constant physical contact is maintained between the connecting members 52 and the yoke combination 30, and the connecting member 52 and the platform 29 throughout the range of yoke adjustment. For example, the yoke combination-platform can be fixed in permanent nonadjustable position through ultrasonic welding in which the constant physical contact previously described provides a fairly large weld region thereby encouraging bonding strength. Providing a plurality of contact points 59, shown in FIG. 6, may be preferable so as to enable quick welding with low power requirements, as is known in the art.

It may be preferable to shape the recesses 40 and/or 50 such that the end portions 54*a* and 54*b* and the receiving recesses 40 and 50 are provided with an interference fit wherein the end portions 54*a* and 54*b* can be welded into the recesses 40 and 50 such that stresses are relieved upon the welding, as is known in the art. By interference fit it is meant that the end portion 54*a* and/or 54*b* is slightly larger than the recesses 40 and 50, i.e., translation of the end portion 54*a* and 54*b* in the recesses 40 and 50 occurs only with displacement of material. In addition, the interference fit provides material for the weld. For convenience in use, the weld point, i.e., the point at which the ultrasonic tool is applied, should be at a recess 50 in the yoke combination 30 or the end portion 54*b* of the connecting member 52 so as to provide for some misalignment without adverse effect on the weld. Thus, the ultrasonic weld provides a clean system in which the parts themselves are used for weld material. In addition, ultrasonic fastening provides a virtually instantaneous weld, e.g., less than 1 sec., and fast cooling, e.g., 5–10 seconds or less.

Although the yoke mount assembly of the present invention has been described with rigid connecting members having substantially spherical end portions and a cylindrical portion therebetween, it is apparent that any end portion shape which could maintain substantially constant physical contact with the receiving recesses and permit the necessary translations would also be successful. Thus, there is provided by the present invention a yoke mount assembly for a cathode-ray tube which substantially minimizes the problems of the prior art.

I claim:

1. A yoke mount assembly for a television picture tube of the type having a magnetic deflection yoke in operational relationship with the tube, a platform positioned on the external surface of the tube, and a yoke combination which includes a housing which encloses at least a portion of the yoke, wherein the improvement comprises:

a plurality of rigid members disposed between and connecting said yoke combination and said platform, said connecting members permitting adjustment of the position of said yoke combination with respect to said platform, said adjustment including rotational translation of said yoke combination with respect to said platform, each of said connecting members having a pair of end portions shaped such that substantially constant physical contact is maintained between one of said end portions of said connecting member and said yoke combination and the other of said end portions and said platform while said yoke position is adjusted.

2. A yoke mount assembly in accordance with claim 1 in which said end portions of each one of said connecting members are substantially spherically shaped and said yoke combination and said platform each include a plurality of recesses for closely receiving said end portions of said connecting members with substantially constant physical contact being maintained between said end portions and said receiving recesses.

3. A yoke mount assembly in accordance with claim 2 in which the end portions of said connecting members in said platform recesses are capable only of pivotal motion in said platform recesses.

4. A yoke mount assembly in accordance with claim 2 in which at least one of said end portions of each of said connecting members contacts its receiving recess in a plurality of contact points.

5. A yoke mount assembly in accordance with claim 2 in which at least one of said end portions of each of said connecting members contacts its receiving recess in a plurality of ridges.

6. A yoke mount assembly in accordance with claim 2 in which said platform recesses receive said end portions of said connecting members in locking fashion such that when said yoke combination is connected to said platform substantially no translation of said yoke combination-platform-tube adjustment is possible until predetermined release forces are provided.

7. A yoke mount assembly in accordance with claim 6 in which said platform recesses include a locking region of slightly smaller size than said end portion such that a force is required to snap said end portion into and out of said recess.

8. A yoke mount assembly in accordance with claim 7 in which said end portions of said connection members in said platform recesses are capable only of pivotal motion in said platform recesses.

9. A yoke mount assembly in accordance with claim 2 in which said end portions of said connecting members and said receiving recesses are provided with an interference fit such that said end portions can be welded into said recesses whereby stresses are relieved upon welding.

10. A yoke mount assembly in accordance with claim 2 in which at least one of said end portions of each of said connecting members is bonded to its receiving recess with an adhesive material.

* * * * *